United States Patent [19]

Karl et al.

[11] 4,148,107

[45] Apr. 10, 1979

[54] MOORING BUOY

[75] Inventors: Robert D. Karl, Pacific Palisades; William R. Reid, Jr., Northridge, both of Calif.

[73] Assignee: Amtel, Inc, Providence, R.I.

[21] Appl. No.: 772,828

[22] Filed: Feb. 28, 1977

[51] Int. Cl.[2] ..... B63B 21/00

[52] U.S. Cl. ..... 9/8 P; 114/230

[58] Field of Search ..... 9/8 P; 114/230; 141/387, 388, 279

[56] References Cited

U.S. PATENT DOCUMENTS

| | | | |
|---|---|---|---|
| 3,067,716 | 12/1962 | Norlin | 114/230 |
| 3,074,082 | 1/1963 | Griebe | 114/230 |
| 3,572,408 | 3/1971 | Hnot | 114/230 X |
| 3,956,742 | 5/1976 | Karl | 114/230 |
| 3,961,490 | 6/1976 | Corgnet | 114/230 |

FOREIGN PATENT DOCUMENTS

| | | | |
|---|---|---|---|
| 1939013 | 2/1970 | Fed. Rep. of Germany | 114/230 |

*Primary Examiner*—Edward R. Kazenske
*Assistant Examiner*—Sherman D. Basinger
*Attorney, Agent, or Firm*—Freilich, Hornbaker, Wasserman, Rosen & Fernandez

[57] ABSTRACT

A buoy for mooring vessels, has a rotatable turntable on the top, which rotates about the vertical axis of the buoy. A mooring yoke which couples to ships at one end has the other end pivotably attached to the turntable so that it is pivotable about a horizontal axis. The mooring yoke has bumper equipment on either side of the location of the pivotable axis so that its pivotable motion can be restricted to a predetermined arc.

2 Claims, 3 Drawing Figures

MOORING BUOY

BACKGROUND OF THE INVENTION

This invention relates to improvements in buoys for mooring ships.

In U.S. Pat. Nos. 3,823,432 and 3,908,212, there are described and shown buoys with associated mooring yokes, which are attached to the buoys in such a manner that they form a rigid integral unit therewith. In one instance the mooring yoke is rigidly attached to the buoy which rotates in a bearing which surrounds the periphery of the buoy, and in the other instance the mooring yoke is attached, rigidly, to a turntable which rotates on the top of the buoy. The purpose for this type of coupling is indicated as being required because buoys with associated mooring arrangements of the type known in the prior art, which constitutes a yoke pivotably hinged with respect to a turntable on top of the buoy, are subjected to tidal and weather conditions which require the buoy to have a considerable adherent stability to cope with the forces exercised thereon by the mooring arrangement, which causes them to tip the buoy. To overcome this tipping proclivity, the buoy needs to have a relatively large mass, with the result that the forces to which the rigid coupling members coupling the buoys to the mooring arrangement are also of considerable magnitude.

It is indicated in the patent, that the buoy is coupled to the mooring arrangement in a manner which may be likened to the manner in which a wheel barrow is held by its user. The single wheel of the wheel barrow may be likened to the buoy and the two handles thereof to the coupling members, and the mooring arrangement to the user of the wheel barrow, such that any lateral roll of the ship is transferred to the buoy via the rigid coupling members in the same way that any lateral tilting of the barrow by the user will be transferred from the handles to the single front wheel. The benefit of these arrangements is that by essentially making the buoy and the yoke unitary, except for the pivoting capability, the requirement for the buoy to have a relatively large mass to provide inherent stability is considerably reduced, and the buoy's tendency to tip in response to these forces is also reduced.

A problem that arises in rigidly coupling the yoke to the turntable on a two-way bearing ring around the periphery of the buoy is that the portion of the yoke which is attached to the deck or to the bearing is very large, very cumbersome, and very expensive. Also, in view of the rigid coupling of the yoke to the buoy, there is no provision for adjustment of the yoke attitude relative to a moored vessel. Further, assembly of a yoke constructed in the manner described as well as removal of the yoke for any reason, is a complex and cumbersome job and requires removal of the bearing.

OBJECTS AND SUMMARY OF THE INVENTION

An object of this invention is to provide an arrangement for the construction and coupling of a yoke arm to a mooring buoy which is simple to assemble and disassemble and yet provides the benefits of a rigidly coupled yoke and mooring buoy of the type described.

Another object of the present invention is to provide an arrangement for the yoke coupled to a mooring buoy which allows for adjustment on the yoke attitude relative to a moored vessel.

Still another object of the present invention is to provide for the structure of a yoke coupled to a mooring buoy which does not require the mooring buoy to have a relatively large mass to provide stability.

The foregoing and other objects of the invention are achieved by a yoke which is pivotably coupled to the turntable on top of a mooring buoy by a pin. In addition, on either side of the pin coupling, which extends in a horizontal direction, there are provided adjustable snubbing elements or bumpers which serve to limit the pivoting action of the yoke whereby when the yoke pivots to the extent permitted by the adjustable extensions, to all intensive purposes the yoke and buoy act as if they were rigidly coupled to provide the benefits obtained as a result of the rigid coupling. The extensions may include shock absorbers which may be hydraulic or spring type.

DESCRIPTION OF THE PREFERRED EMBODIMENTS

Figure 2:
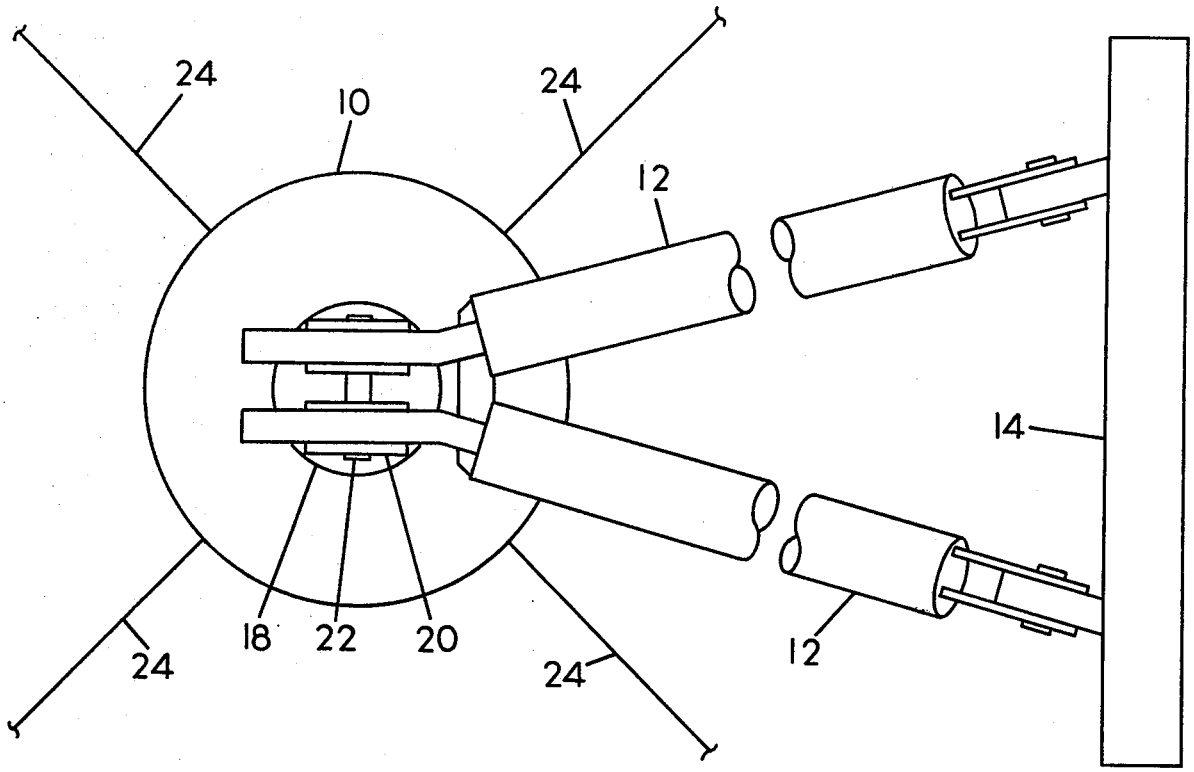
FIG. 2 is a plan view of the structure shown in FIG. 1.
Figure 1:
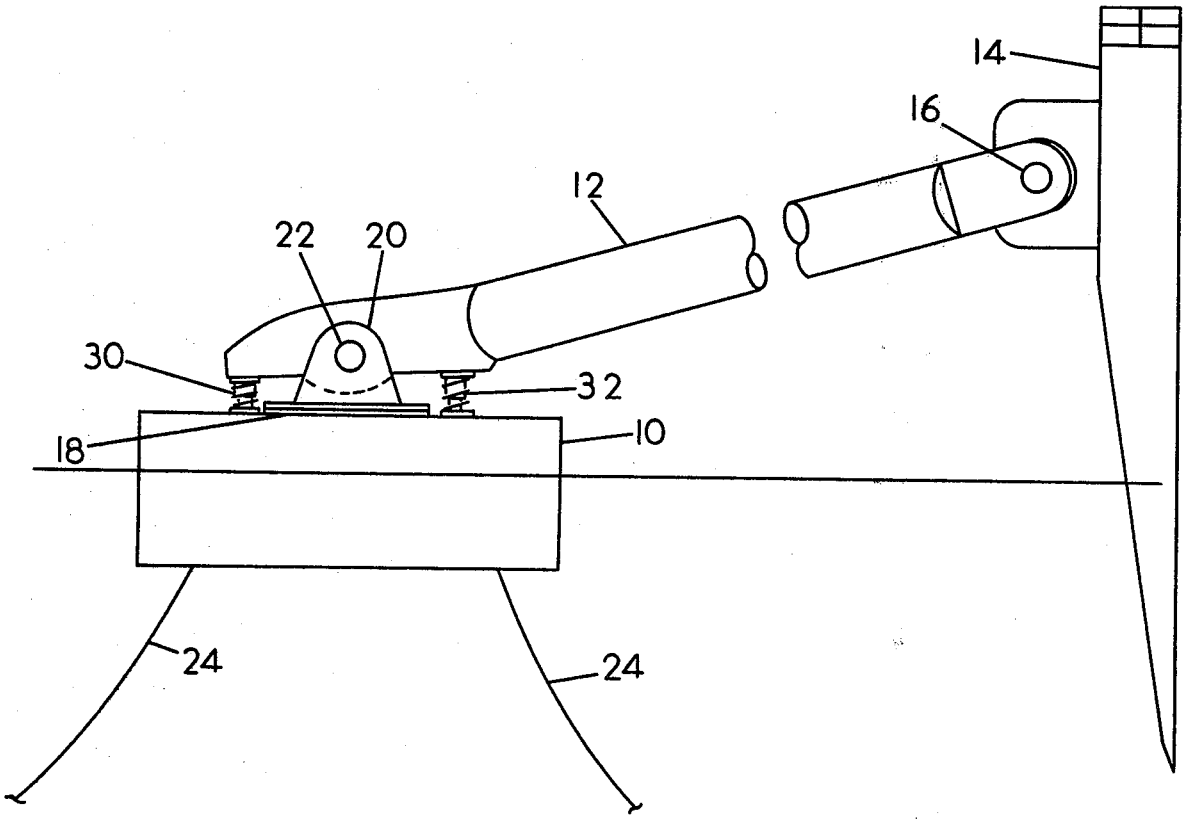
FIG. 1 is a view in elevation illustrating a ship moored to a buoy through a yoke having a construction at the mooring buoy end in accordance with this invention.

Referring now to FIGS. 1 and 2, there may be seen a mooring buoy 10, having a mooring arm or yoke 12, attached thereto, and a ship 14 attached to the mooring arm. The coupling of the yoke to the ship is by means of a pin 16, which allows rotation of the yoke about the vertical axis of the buoy. The buoy is anchored to the bottom of the sea by chains.

The buoy has a rotatable deck 18 on top, which is rotatable about a vertical axis through the buoy. Mounted on the deck is a bearing support 20, supporting, horizontally, a bearing 22, to which the yoke arm 12 is pivotably coupled. This enables the yoke arm to rotate about a horizontal axis.

The buoy 10 is anchored to the sea bottom by means of chains 24.

Figure 3:
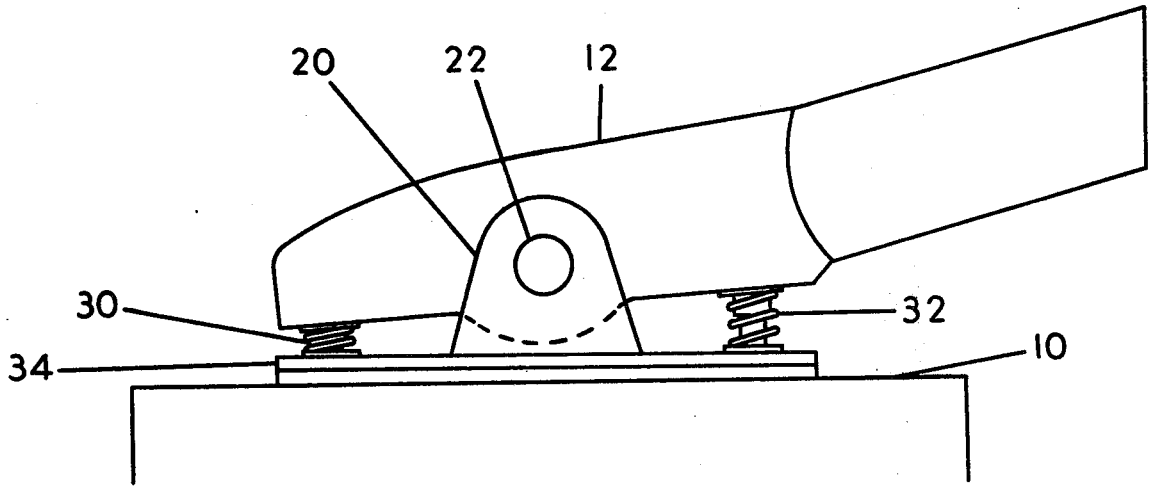
FIG. 3 is an enlarged view illustrating another embodiment of this invention.

On either side of the location at which the yoke is pivotably coupled to the buoy, by means of the bearing 22, there are placed snubbing elements 30, 32. Four of these may be used. These are yieldably adjustable and may either be spring biased or hydraulically biased to permit some pivotal motion of the yoke arm when it is tilted by reason of the motion of the ship, or buoy, relative thereto. When the predetermined limit of pivoting motion has been reached one or the other of these snubbing elements which is in contact with the top of the buoy, will no longer yield, preventing further pivotal motion. In other words, these elements act as shock absorbers and will contract under pressure to a limited extent. This extent can be predetermined, in the same manner that the extent of motion allowed a shock absorber in response to a load can be predetermined. Element 30, as shown, is shorter than element 32, because of the angle given to the yoke by the ship. The end of a snubber element which comes in contact with the top deck, can be a slide shoe or glide, which slides over the buoy surface. It can also be a wheel, or bearing, which rolls on the buoy surface, or, as shown in FIG. 3 the rotatable deck can be made wide enough so that the snubber elements will directly impact the rotatable deck. The point to emphasize is that the snubber element does effectively terminate the rotation of the yoke arm about the horizontal axis after a predetermined amount of pivotable rotation has occurred, whereby, for further pivotal motion, the yoke arm and buoy, for all intents and purposes are rigidly coupled with one another. As a result, all of the benefits obtained from a yoke arm which is rigidly coupled to a buoy as shown in the prior art, may be realized without the drawbacks, as enumerated above. Further, the advantages of construction and operation of a pivotably connected buoy and mooring yoke are also obtained.

FIG. 3 illustrates another and preferred embodiment of the invention. Structures in FIG. 3 which are similar to that in FIGS. 1 and 2 bear the same reference numerals. In this embodiment of the invention, a rotating deck 34 is provided which has a sufficiently large diameter, so that the snubber elements 30, 32 rest on the rotating deck and rotate therewith, thereby avoiding the need for slides or wheels as with the previous embodiment of this invention. The snubbing elements may be fixedly attached to yoke arms and rest on the rotating deck, or they may be fixedly attached to the rotating deck and the yoke arms then contacts them in operation, or they may be fixedly connected to both yoke arms and rotating deck.

If desired, the buoy shown in the drawings may be equipped with means for enabling the transfer of liquid product from shore to ship, or vice versa, using a pipeline connecting to shore, from underneath the buoy, then up through the center of the buoy by a suitable pipe line and coupling and then through a suitable swivel and pipeline, from the top of the buoy to the ship. The technical information, as well as hardware for accomplishing this, are well known and commercially available and thus will not be described here.

There has accordingly been described and shown herein a novel useful and improved construction for a coupling arrangement between a mooring buoy and a yoke arm connected thereto, which is used for mooring a vessel.

We claim:

1. A buoy for mooring vessels comprising:

a floating body having a top side, yoke means having one end adapted for removable coupling to a ship, bearing means mounted on said top side and coupled to a location near said yoke means other end to permit rotation of said yoke means about a horizontal axis, and snubber means positioned between said yoke means and the top side of said floating body for limiting free pivotal action of said yoke means about said horizontal axis with respect to the top side of said body to a predetermined amount beyond which pivotal forces on said yoke means are also applied to said floating body by said snubber means, said snubber means comprises at least first and second spring means for applying pivotal forces to said yoke means to pivot about said horizontal axis in opposite directions when said yoke means compresses said first spring means or said second spring means respectively, with said free pivotal motion being limited to said predetermined amount when either of said spring means is fully compressed.

2. A buoy for mooring vessels comprising:

a floating body having a top side, yoke means having one end adapted for removable coupling to a ship, turntable means rotatably mounted on said top side for rotating about the vertical axis of said floating body, bearing means mounted on said turntable means and coupled to a location near said yoke means other end to permit rotation of said yoke means about a horizontal axis, and snubber means mounted and extending between said turntable and said yoke means, located at either side of said bearing means, for applying forces received from said yoke means to said turntable means, only when said yoke means pivots a predetermined angle either above or below said horizontal axis, said snubber means comprises at least first and second spring means for applying pivotal forces to said yoke means to pivot about said horizontal axis in opposite directions when said yoke means compresses said first spring means or said second spring means respectively, with said free pivotal motion being limited to said predetermined amount when either of said spring means is fully compressed.

* * * * *